US006302974B1

(12) United States Patent
Wilhelm et al.

(10) Patent No.: US 6,302,974 B1
(45) Date of Patent: Oct. 16, 2001

(54) METHOD AND APPARATUS FOR STRAIGHTENING TURBINE CASINGS

(75) Inventors: Peter L. Wilhelm; Bruno Stoeckli, both of Midlothian, VA (US)

(73) Assignee: ABB Power Generation, Midlothian, VA (US)

( * ) Notice: Subject to any disclaimer, the term of this patent is extended or adjusted under 35 U.S.C. 154(b) by 0 days.

(21) Appl. No.: 09/296,617

(22) Filed: Apr. 23, 1999

Related U.S. Application Data

(60) Provisional application No. 60/082,732, filed on Apr. 23, 1998.

(51) Int. Cl.[7] ..... C21D 1/68; C21D 8/10

(52) U.S. Cl. ..... 148/519; 148/590; 148/592; 148/594

(58) Field of Search ..... 148/519, 589, 148/590, 592, 594, 320, 325; 72/342.1, 342.7, 364

(56) References Cited

U.S. PATENT DOCUMENTS 4,989,433 2/1991 Harmon et al. ..... 72/342.7

5,660,650 8/1997 Okita et al. ..... 148/589

*Primary Examiner*—George Wyszomierski

(74) *Attorney, Agent, or Firm*—Oblon, Spivak, McClelland, Maier & Neustadt, P.C.

(57) ABSTRACT

An austenitic rounding fixture is inserted into the horizontal joint of a turbine casing. The casing is then assembled and stress relief cycle is carried out, resulting in rerounding of the casing and relief of residual stresses. Since an austenitic material has a higher thermal expansion coefficient than the metallic materials of conventional turbine casings, the rounding fixtures expand more than the casing during a stress relief cycle. The length of the fixtures are designed in such a way that at stress relief temperature the casing is slightly over-rounded. After the stress relief, the casing is rerounded and the austenitic rounding Fixtures is disengaged. The rounding fixture is installed in a cold condition (or with minimal heat for heavily collapsed casings). The removal of the rounding fixtures is easy since a clearance exists between the casing and the fixtures; the spring back of the casing is far less then the contraction of the fixtures. The stresses in the casing are far less than if rounding plates would have been used since the maximum deformation occurs at stress relief temperature.

8 Claims, 3 Drawing Sheets

METHOD AND APPARATUS FOR STRAIGHTENING TURBINE CASINGS

This application claims priority of provisional application Serial No. 60/082,732 filed Apr. 23, 1998.

BACKGROUND OF THE INVENTION

1. Field of the Invention

The invention relates to a method and apparatus for straightening turbine casings.

2. Description of the Related Art

Through years of operation, turbine casings are repeatedly subjected to high thermally induced stresses above the yield point of the material. The reasons for this include the fact that outer surface of a inner casing of a steam turbine is normally cooled by exhaust steam, which is up to 300° C. cooler than the highest steam temperature inside the casing. This leads to a significant steam temperature gradient in the wall of the inner casing. The temperature gradient over the casing wall causes thermal stress in the wall. Also, due to high thermal gradients which occur during start up, shut down, and abnormal operation, turbine casings distort during operation. The distortion is generally a collapse of both halves and get worse with time. In general, compressive stresses at the inner rim and tensile stresses at the outer rim are generated. In the case of shrink ring casing all stresses are compressive with higher stress at the inner rim.

Additionally, in the cold condition after operation, the negative creep strains introduced by the relaxation process during the operation period causes considerable tensile stress in the inner portion of the casing wall. Once the casing is disassembled and the casing halves can move freely, the bending portion of the stress disappears, thus causing a change of curvature of the casing wall and overall distortion of the casing.

Some of the stresses can become locked into the casing due to local yielding of adjacent material. This results in both casing distortion and residual casing stresses. The residual stresses continue to increase in size and quality resulting in cracking and/or casing distortion.

A distorted casing will also change the radial clearances to the rotor. Because a distorted casing takes the shape of an ellipse, the clearance between the rotor and casing will increase in some areas and will be reduced in others. Increased clearances provide efficiency loss, while decreased clearances increase the risk of rubbing and a possible forced outage. Providing a reliable method of rounding casings gives the industry a good incentive to perform rounding on a regular schedule to regain lost efficiency and to minimize the risk of a forced outage.

Distorted casings should be rerounded to allow trouble free assembly/disassembly of both halves, allow trouble free installation of blade carriers or diaphragms, close the horizontal joint face in order to minimize steam leakage, allow concentrical remachining, remove residual stresses, and establish design seal clearances.

A conventional method of straightening turbine casings is known as "hot spotting." This process includes local heating of the outside surface of the casing (spot heating). A small area is heated rapidly to introduce local yielding. The heating is done in small spot lines and covers the entire outer surface of the casing. In the area of the steam inlet pipes, the space is very limited and therefore no major rerounding can be achieved there. Stress relief of the casing may optionally be provided after the hot spotting. Otherwise, stress relief is performed after the rerounding operation.

Hot spotting is not an entirely satisfactory technique for straightening turbine casings. It can only be applied to rather flimsy casings. Also, several attempts need to be made and the results are not predictable. Spot heating by torch is uncontrolled and may overheat and alter the heated area of the casing. Features such as the steam inlet pipes do not allow the casing to straighten uniformly. Stress relief after straightening to reduce the possibility of cracking, also reduces the amount of rerounding achieved. The relaxation can only be estimated. Since the heat straightening provides a casing with a nonuniform collapse, matching of the seals and shrouds causes a problem. Seal clearances need to be increased depending on the remaining collapse and therefore the unit efficiency decreases.

Casing straightening using rounding plates has also been done for heavy wall casings with flanges, which cannot be straightened by heat spot straightening. The rounding plates are used during a stress relief cycle. The rounding plates are designed to be inserted into several areas of the casing to keep the casing in a defined shape during the stress relief process. Since the rounding plates are bigger then the casing, heat needs to be applied to the inside of the casing to open it and the process of installing the plates needs to be planned carefully.

The interior of the lower half of the casing is first heated with torches, while the opening of the casing is carefully monitored. Rounding plates are then installed as soon as the resulting expansion of the opening allows. After all rounding plates are installed in the lower casing, the upper casing is expanded in the same way. After verification that the applied heat has expanded the casing enough, it is laid onto the lower half.

Temporary bolts are then installed to clamp the two halves together. The casing with the rounding plates installed is then be stress relieved in an oven. Due to remaining residual stresses, the casing needs to be over-rounded. The "spring back" of the casing applies substantial force to the rounding plates, even after stress relief, and can make the separation of the two halves very tricky.

This method yields better results then the heat spot straightening and the outcome is more predictable. However it requires detailed planning and execution to insert the rounding plates, the potential exists of stocked rounding fixtures in the upper and/or lower half of the casing and the introduction of stresses to the casing in cold conditions.

See also, Herbert Barsch. *A New Creep Equation for Ferritic and Martensitic Steels.* Steel Research, No. 9, Vol. 66, 1995, p. 384ff.; *On Site Reround of a Turbine Inner Cylinder* by D. Ginn and R. Acton, ASME/IEEE Power Generation Conference, Milwaukee, Wis., Oct. 20–24, 1985; *On-Site* 430 *MW High Pressure Turbine Shell Cracking and Distortion Repair* by D. Rasmussen and M. Hilkey, all of which are hereby incorporated by reference.

SUMMARY OF THE INVENTION

It is an object of the invention to provide a method of straightening turbine casings which provides predictable results and does not have the disadvantages associated with the straightening of casings using rounding plates.

It is a further object of the invention to provide a method of straightening turbine casings which is simple and keeps the stresses the to a minimum.

It is yet a further object of the invention to provide a fixture usable for straightening turbine casings.

According to a feature of the invention, the above and other objects are achieved by a method of rounding a turbine casing, comprising inserting a rounding fixture substantially having the thermal expansion characteristics of an austenitic material into a metallic turbine casing, and heating the turbine casing and the rounding fixture therein substantially to the stress relief temperature of the material of the turbine casing.

According to another feature of the invention, the above and other objects are achieved by a method of rounding a turbine casing, comprising inserting a rounding fixture substantially having the thermal expansion characteristics of an austenitic material into a metallic turbine casing; and subjecting the turbine casing and the rounding fixture therein to a stress relief cycle of the turbine casing.

According to yet another feature of the invention, the above and other objects are achieved by a rounding fixture to be used in rounding a turbine casing, comprising a body having a shape dependent on a shape of a turbine casing to be rounded and being formed of a material substantially having the thermal expansion characteristics of an austenitic material.

Austenitic materials such as austenitic steels or steel alloys are well known. Since an austenitic material has a higher thermal expansion coefficient than the metallic materials of conventional turbine casings (the materials of turbine casings are also well known and are not further described therein), the rounding fixtures expand more than the casing during a stress relief cycle.

The austenitic rounding fixture is inserted into the horizontal joint of the lower casing. The upper casing is then assembled with the lower casing. A stress relief cycle is carried out, resulting in rerounding of the casing and relief of residual stresses. The length of the fixture is designed in such a way that at stress relief temperature the casing is slightly over-rounded. After the stress relief, the casing is rerounded and the austenitic rounding fixture is disengaged.

The described method allows one to install the rounding fixture in a cold condition (or with minimal heat for heavily collapsed casings). The removal of the rounding fixture is easy since a clearance exists between the casing and the fixture; the spring back of the casing is far less then the contraction of the fixture. The stresses in the casing are far less than if rounding plates would have been used since the maximum deformation occurs at stress relief temperature.

Growing of existing cracks or introducing new cracks during the straightening process are reduced to a minimum. The major straightening forces applied occur far above the $FATT_{50}$ temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Referring to the exemplary figures, a rounding fixture 2 formed of an austenitic material or having the thermal expansion characteristics of an austenitic material is inserted into the horizontal joint of a disassembled casing 6, or another location depending on the casing configuration. Austenitic materials such as austenitic steels or alloys, per se, are well known and will not be further described herein. The shape and size of the fixture 2 is dependent on the shape of the turbine casing to be rounded and the required strength, but it can be a bar, disk or plate. It can also include a support 4.

Figure 1:
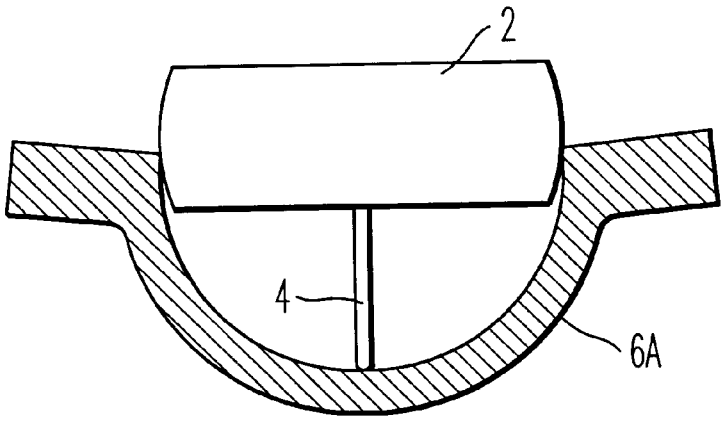
FIG. 1 shows a fixture according to the invention placed inside a lower casing half.
Figure 2:
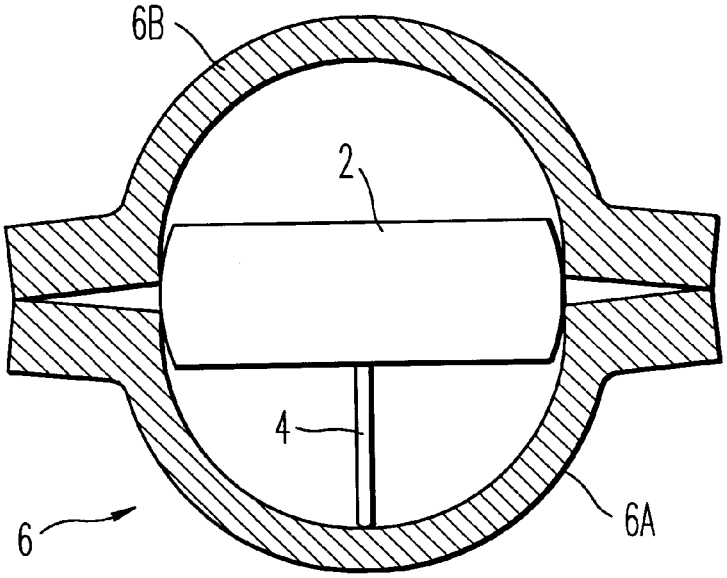
FIG. 2 shows the assembled casing having the fixture therein.

The casing halves 6A and 6B are then assembled such that the assembled casing halves straddle the rounding fixture 2 (FIG. 2). Although not shown, this involves engaging the elements used to assemble the casing, e.g., bolts passing through the casing half flanges, so that the casing is securely assembled and will resist rounding forces. FIG. 2 shows the distortion, in exaggerated form, as a misalignment of the casing flanges. For casings with major distortion, heating of the inside of the casing surface may be required to insert the rounding fixtures and to assemble the upper half.

Figure 3:
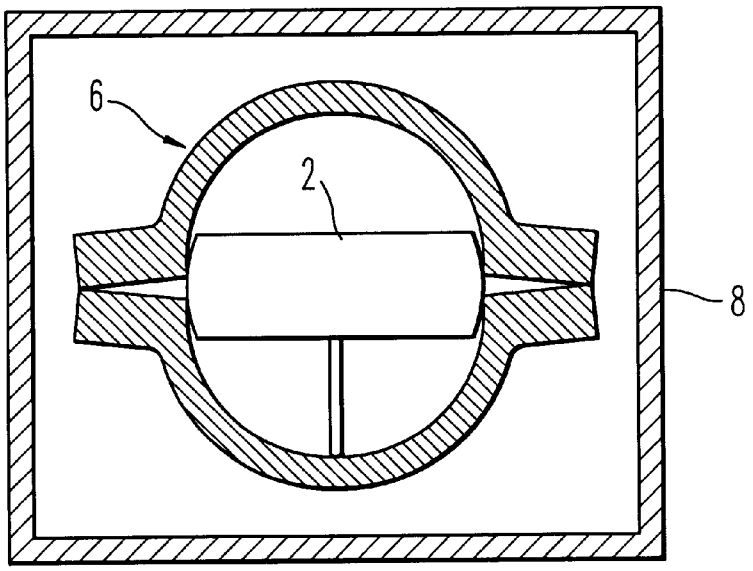
FIG. 3 shows the assembled casing having the fixture therein positioned in an oven for stress relief.

Stress relief is then carried out, wherein the fixture rerounds the casing, and relieving residual stresses. The austenitic rounding fixture 2 rerounds the casing 6 during a stress relief process; since austenitic material expands more then turbine casing material when heated, the difference in expansion can be used to provide the necessary forces to reround the casing. The stress relief may be performed by placing the turbine casing 6 and the rounding fixture therein in an oven 8 (FIG. 3), slowly heating the turbine casing 6 and the rounding fixture 2 therein substantially to the stress relief temperature of the material of the turbine casing, temperature, and slowly cooling the turbine casing and the rounding fixture therein. Since austenitic material has a higher thermal expansion coefficient than the material of the turbine casing, the austenitic rounding fixtures expands more than the casing during the stress relief cycle to apply the necessary rerounding to the casing.

Figure 4:
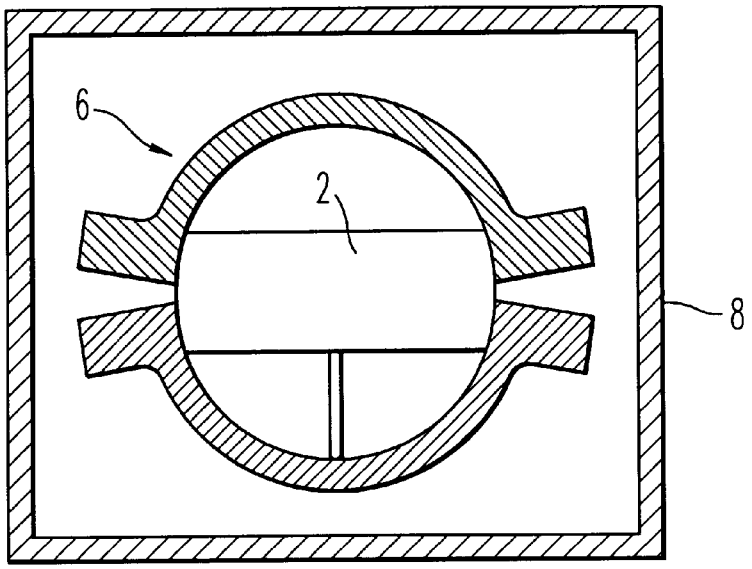
FIG. 4 shows the assembled casing having the fixture therein positioned in an oven during stress relief and shows the over-rounding.
Figure 5:
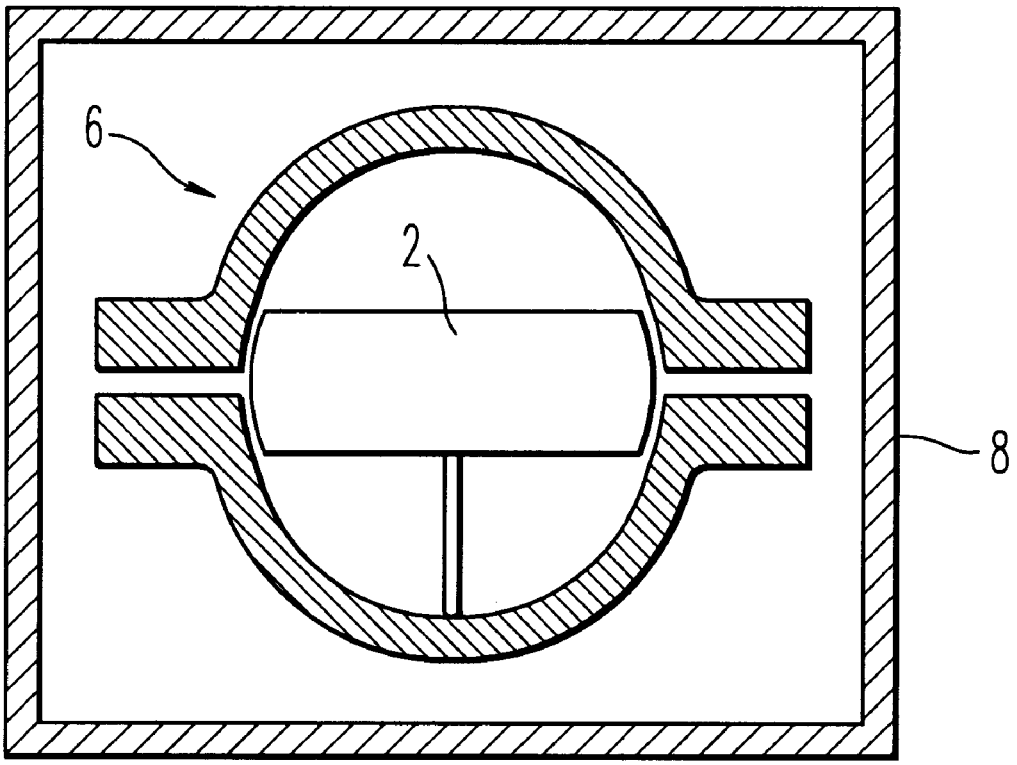
FIG. 5 shows the assembled casing having the fixture therein positioned in an oven after stress relief.

The size of the austenitic rounding fixture 2 is designed in such a way that at stress relief temperature, the casing 6 will be slightly over-rounded to compensate for the spring back during the cool down (FIG. 4). The casing is then allowed to slowly cool, and will be correctly rounded (FIG. 5).

The inventive method, by using an austenitic rounding fixture, has a number of significant advantages over the known methods. First, it allows very accurate control of the rounding. Secondly, it provides easier installation and removal of the rounding fixtures (i.e. the rounding fixtures can be installed and removed without needing to first spread the collapsed casing open; or with only minimal spreading for severely collapsed casings). Additionally, the stresses induced in the casing with this method are far less than in conventional rounding approaches. This is because the maximum deformation occurs at the stress relief temperature, at which the material of the casing material has the lowest yield strength.

Also, growing of existing cracks or introducing new cracks during the rounding process are reduced to a minimum since the forces are applied far above the $FATT_{50}$ temperature.

EXAMPLE

For the calculation of the inner casing distortions and the straightening, an ABB (Asea Brown Bovari) shrink ring turbine casing design was used as an example. The two inner casing halves were designed without flanges and were held together with 5–7 shrink rings. The casing typically has an oversize of 0.1%. The casing is assembled and disassembled by heating the rings.

Finite Element calculations were performed, using the finite element code ABAQUS 5.7[ABB Power Generation, Ltd.]. For the sake of a better understanding and visualization of the fundamental effects during the deformation and the straightening process, 2D models were analyzed in a first step. These models represent a cross section of the casing perpendicular to the turbine axis.

The material behavior considers elasticity, plasticity and creep. Creep was modeled using a creep law of a generalized Garofalo type. The creep model was defined for primary and secondary creep. For the calculation a quarter of the casing was modeled. At the top of the casing boundary conditions for symmetry were used, at the flange gap elements were introduced. For the shrink ring symmetric boundary conditions were applied at the top and the flange side. The operation and straightening process was modeled by the following steps:

1. Assembly of the casing. Between casing and ring a shrinkage of 0.1% was applied.
2. Steady state operation for 50.000 hours. Steady state temperature and pressure were applied. The deformation and stresses due to creep and plasticity were calculated.
3. Straightening of the casing. To straighten the casing, the shrink rings were removed. For comparison, the conventional hot spot and rounding plate methods were simulated.
4. Reassembly of the casing. Shrink rings were assembled again with the initial shrinkage of 0.1%.
5. Steady state operation for a second operation period of 50.000 hours. The deformation and stresses due to creep and plasticity were calculated. The results are shown in Table 1.
6. Disassembly of the casing to determine the deformation of the casing in the disassembled condition.

To model the heat spot straightening, heat transfer was introduced at a few elements on the surface of the casing. The transient temperature distribution in the casing was calculated. The temperature calculation was followed by a transient stress (calculation considering plasticity and creep). During spot heating the rerounding of the model was simulated. After cooling down the casing bent back because of internal stresses. The results of the finite element calculation have shown that the internal stresses during and at the end of the straightening process are high. Furthermore, it was very difficult to define the process of spot heating numerically so that the straightening of the casing is optimal. The finite element calculation was not able to predict the results of the real process accurately. This is in accordance with the practical experience that very often, several attempts are needed to straighten a casing in the desired way.

The size of the ferritic rounding plate is larger than the casing. For the finite element simulation the rounding plates were implemented into the casing. The oversize of the plate caused high stresses in the casing. The casing with the installed rounding plates was heated up to 680° C. (1256° F.) in the oven to relieve stresses. After the heat treatment the spring back of the casing was calculated. The straightening results were better than those of the heat spot straightening.

For finite element simulations an austenitic rounding fixture was implemented into the model. A transient temperature calculation was followed by a transient stress calculation. During the process the casing was straightened because of the difference in the thermal expansion coefficients. After the heat treatment process the casing was nearly stress free. After cooling down a small deformation of spring back of the casing was observed.

Table 1 shows a summary of the stresses and the displacements at certain stages of the operation and the straightening procedures:

TABLE 1

Summary of the Straightening Calculation Results

| | | Heat Spot | Rounding Plates | Austenitic Rounding Fixtures |
|---|---|---|---|---|
| After first operation period of 50,000 hours | maximum collapse at flanges [mm, radius] | 2.71 | 2.71 | 2.71 |
| | maximum stress [MPa] | 18.5 | 18.5 | 18.5 |
| Straightening Process | max. stress [MPa] | 481 | 392 | 126.5 |
| | collapse at flanges after straightening [mm, radius] | 2.2 | 0.0 | 0.0 |
| | maximum stress after straightening [MPa] | 481 | 2.7 | 2.4 |
| Second operation period | maximum collapse at flanges after disassembly [mm, radius] | 2.51 | 1.89 | 1.87 |

The comparison of the different methods leads to the following conclusions:

The rerounding procedure can only be predicted accurately for the rounding plates and the austenitic rounding fixtures.

The remaining stresses, and hence the distortions after a second operation period, are only small for the rounding plates and the austenitic rounding fixtures. These distortions are smaller, as there is no more primary creep during the second operation period, which causes a considerable distortion in the first operation period.

In terms of distortions after straightening and after a second operation period, the two methods using rounding plates or austenitic rounding fixtures, respectively, are equivalent.

After straightening with heat spots, significantly larger distortions arise in the second operation period, compared to the use of rounding plates or austenitic rounding fixtures. This is due to the very high residual local stresses introduced into the material. The higher the stresses, the quicker they relax, causing deformations as before the straightening, in addition to the distortions normally arising in a second operation period.

When using the rounding plates, high stresses occur in the cold condition after the assembly of the rounding plates. In an old, potentially cracked or embrittled casing, this might cause crack initiation or uncontrolled crack growth and therefore is very risky. In contrast to this, using austenitic rounding fixtures, the stresses are built up smoothly and to a much smaller level during the heat treatment, thus resulting in a significantly smaller cracking risk.

Due to the uncontrolled amount of heat and the high stresses introduced with the heat spot technique, the results of the straightening are much less predictable and the distortions during subsequent operation are much bigger than for the other methods.

Five austenitic rounding fixtures were produced and inserted into the. Four of the austenitic rounding fixtures were in a horizontal position and one was in a vertical position. All fixtures were designed and installed according to a design and manufacturing procedure. The following was considered:

opening force maximum contact height compressive stresses buckling forces, safety factor pin shear stresses change in length of the fixture due to compression differential thermal expansion To evaluate the quality of the rerounding process, a 3D finite element calculation was performed. The results show that the rerounding of a casing can be predicted using finite element calculations. Turbine casings deform due to stresses from high temperature gradients during operation, leading to assembly and performance problems. The deformation can be calculated by means of FEA. There was a good agreement between the FEA and the actual deformation.

Using austenitic rounding fixtures will provide predictable results, using minimal straightening forces. Growth of existing cracks or introduction of new cracks during the straightening process is reduced to a minimum.

Obviously, numerous modifications and variations of the present invention are possible in light of the above teachings. It is therefore to be understood that the invention may be practiced otherwise than as specifically described herein.

What is claimed is:

1. A method of rounding a turbine casing, comprising:

inserting a rounding fixture substantially having the thermal expansion characteristics of an austenitic material into a metallic turbine casing; and heating the turbine casing and the rounding fixture therein substantially to the stress relief temperature of the material of the turbine casing, wherein said inserting step comprises inserting the rounding fixture into a casing half, and assembling the turbine casing such that the assembled casing halves straddle the rounding fixture.

2. The method of claim 1, including the step of over-rounding the turbine casing at the stress relief temperature.

3. The method of claim 1, including the step of heating an interior surface of the turbine casing prior to said inserting step.

4. The method of claim 1, wherein said heating step is performed by placing the turbine casing and the rounding fixture therein in an oven.

5. A method of rounding a turbine casing, comprising:

inserting a rounding fixture substantially having the thermal expansion characteristics of an austenitic material into a metallic turbine casing; and subjecting the turbine casing and the rounding fixture therein to a stress relief cycle of the turbine casing, wherein said inserting step comprises inserting the rounding fixture into a casing half, and assembling the turbine casing such that the assembled casing halves straddle the rounding fixture.

6. The method of claim 5 including the step of over-rounding the turbine casing in the stress relief cycle.

7. The method of claim 5, including the step of heating an interior surface of the turbine casing prior to said inserting step.

8. The method of claim 5, wherein said stress relief cycle comprises:

placing the turbine casing and the rounding fixture therein in an oven;

slowly heating the turbine casing and the rounding fixture therein substantially to the stress relief temperature of the material of the turbine casing;

soaking the turbine casing and the rounding fixture therein at substantially the stress relief temperature; and slowly cooling the turbine casing and the rounding fixture therein.

* * * * *